US008007195B2

(12) United States Patent
Lange et al.

(10) Patent No.: US 8,007,195 B2
(45) Date of Patent: Aug. 30, 2011

(54) WRITING IMPLEMENT WITH PIVOTING ROLLER

(75) Inventors: Didier Lange, Saint Leonard (FR); Franck Rolion, Belloy-en-France (FR); Vincent Bedhome, Desvres (FR)

(73) Assignee: Societe BIC, Clichy Cedex (FR)

( * ) Notice: Subject to any disclaimer, the term of this patent is extended or adjusted under 35 U.S.C. 154(b) by 911 days.

(21) Appl. No.: 11/568,612

(22) PCT Filed: May 2, 2005

(86) PCT No.: PCT/FR2005/001093

§ 371 (c)(1),
(2), (4) Date: Nov. 2, 2006

(87) PCT Pub. No.: WO2005/115768

PCT Pub. Date: Dec. 8, 2005

(65) Prior Publication Data

US 2007/0217861 A1 Sep. 20, 2007

(30) Foreign Application Priority Data

May 3, 2004 (FR) ..... 04 04705

(51) Int. Cl.
*B43M 11/02* (2006.01)

(52) U.S. Cl. ..... 401/219; 401/215; 401/216

(58) Field of Classification Search ..... 401/193, 401/209, 215, 219, 220, 231, 233, 251, 256, 401/257, 292, 6, 214, 216
See application file for complete search history.

(56) References Cited

U.S. PATENT DOCUMENTS

| | | | | |
|---|---|---|---|---|
| 2,487,483 | A * | 11/1949 | Seckers | 401/216 |
| 2,504,189 | A * | 4/1950 | Ehrhart et al. | 401/208 |
| 3,036,328 | A * | 5/1962 | Schaich | 401/213 |
| 3,085,554 | A | 4/1963 | Caplan | |
| 4,883,380 | A * | 11/1989 | Ritterman | 401/208 |
| 5,709,492 | A * | 1/1998 | Yasunaga et al. | 401/208 |
| 6,190,077 | B1 * | 2/2001 | Newson et al. | 401/192 |
| 6,494,634 | B1 * | 12/2002 | Inoue et al. | 401/216 |

FOREIGN PATENT DOCUMENTS

DE 198 61 166 A1 10/2000

* cited by examiner

*Primary Examiner* — David J Walczak
(74) *Attorney, Agent, or Firm* — Jones Day

(57) ABSTRACT

A writing implement that includes a body which extends longitudinally along a central axis Z; an ink reservoir, and a roller having a radial outer writing surface being located at one of the ends of the body, which is connected to the ink reservoir and is mounted so that it is able to rotate around the primary axis Y. The ink roller is also mounted so that it is able to pivot around a second axis X, which is perpendicular to the primary axis Y and the secondary axis X being secant to the primary axis Y.

13 Claims, 2 Drawing Sheets

WRITING IMPLEMENT WITH PIVOTING ROLLER

This application is a national stage application of PCT/FR2005/001093, filed on May 2, 2005.

FIELD OF INVENTION

The embodiments of the present invention relate to a writing implement.

BACKGROUND OF INVENTION

More particularly, the embodiments of the present invention relate to a writing implement comprising:

a body which extends longitudinally along a central axis Z, the body having a first end and second end;

an ink reservoir; and and a roller having an outer writing surface, the roller being located at one of the ends of the body, connected to the ink reservoir and mounted so as to be able to rotate around a primary axis.

This type of writing implement is particularly well suited to highlighter pens, owing to the width and speed of marking it allows. It can also be used to apply a pattern or a repetitive decorative message.

As described in document U.S. Pat. No. 3,085,554, a writing implement of the type described above comprises a cylindrical writing roller which, when the writing implement is used, turns on itself around an axis perpendicular to the central axis of the body.

The writing roller of an embodiment of the present invention comprises hemispherical ends guided by rounded cavities which allow limited angular movement around the central axis of the body of the writing implement, in order to produce lines of varied thickness. The thickness of the lines depend on the angle at which the user chooses to hold the body, the direction of writing and the angle of the writing roller with respect to this direction. The writing implement of an embodiment of the present invention produces a line of maximum thickness when the axis of the roller is perpendicular to the direction of writing and parallel to the writing surface.

However, if the body of the implement is tilted in a plane normal to the direction of writing, for example when the user naturally tilts the pen toward him, the roller is no longer parallel to the sheet and only one end of the roller is in contact with it.

Roller-type writing implements are thus generally not very comfortable to use, especially when the user wants to draw a horizontal line of writing of maximum thickness.

SUMMARY OF INVENTION

The embodiments of the present invention aim in particular to overcome these drawbacks.

To this end, according to the embodiments of the present invention, a writing implement of the type in question is characterized in that the writing roller is mounted so as to be able to pivot around a secondary axis perpendicular to the primary axis.

By virtue of these arrangements, the writing implement may be used with a natural position and makes it possible to produce a line of writing of maximum width even if it is tilted.

In various embodiments of the writing implement according to the present invention, one and/or other of the following arrangements may also be employed:

the secondary axis X of pivoting of the writing roller and the central axis Z are secant;

the primary axis Y is defined by a pin which comprises, in its middle region, a spherical portion that forms a ball joint with the writing roller;

the diameter of the spherical portion is greater than the average diameter of the pin;

the writing roller is a hollow tube whose inside diameter increases toward its ends:

the diameter of the spherical portion is substantially equal to the minimum diameter of the hollow tube of the writing roller;

the body has two housings of elongate shape along the central axis Z, on either side of the pin, the pin being mounted in the housings and being able to slide in them in a direction substantially parallel to the central axis Z;

the pin is mounted so as to be able to rotate in the housings;

the writing roller is connected to the ink reservoir by means of an ink pad, the ink pad being in communication at one of its ends with the reservoir and being in contact with the roller at its other end, to convey the ink from the reservoir to the roller, the outer surface of the roller is cylindrical.

BRIEF DESCRIPTION OF DRAWINGS

Further features and advantages of the invention will emerge from the following description of one of its embodiments, provided by way of non-limiting example, with reference to the attached drawings.

In the drawings.

In the various figures, the same references denote identical or similar elements.

DETAILED DESCRIPTION OF DRAWINGS

Figure 1:
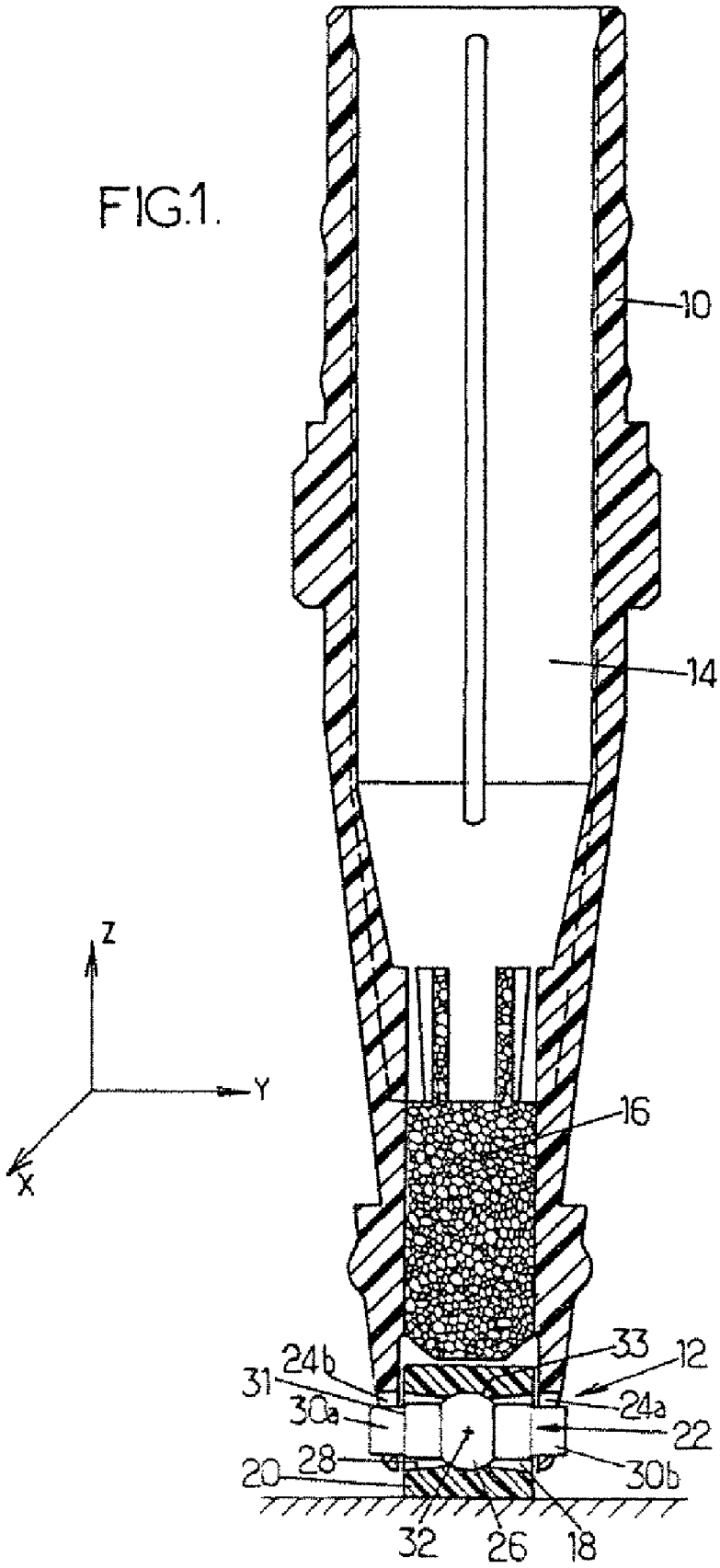
FIG. 1 is a longitudinal sectional view of the writing implement according to an embodiment of the present invention in a position perpendicular to the writing plane.

FIG. 1 is a longitudinal sectional view of the writing implement according to the invention. It comprises a body 10 which extends along the central axis Z, of essentially cylindrical shape, one end of which narrows toward the roller 12. At the opposite end of the writing roller 12, the body 10 comprises an ink reservoir 14. Between the writing roller 12 and the ink reservoir 14 is an ink pad 16, consisting of a porous material such as foam, which is sufficiently permeable to allow the ink to flow.

The writing roller 12 is mounted so as to be able to rotate around a primary axis Y, perpendicular to the central axis Z. The writing roller 12 has a radial outer surface at least part of which serves to deposit the ink on the writing surface. In FIG. 1, the roller is a hollow cylindrical tube 18 the width of whose outer surface 20 determines the maximum width of the line of writing. However, the outer surface could be more or less domed.

The writing roller 12 is mounted so as to be able to rotate around a pin 22, located in the hollow tube 18 and defining the primary axis of rotation Y when it is in the neutral position. The pin 22 is placed at each end in a housing 24*a*, 24*b* of the body 10 of the writing implement, and is free to turn on itself.

In its middle region, the pin 22 has a spherical portion 26 whose diameter is greater than the diameter of the pin 22, and slightly greater than or equal to the minimum diameter of the hollow tube 18. The spherical portion 26 is thus in contact with the internal part 28 of the wall of the writing roller 12.

Arms 30*a*, 30*b* extend from each side of the spherical portion 26, forming the pin 22. The arms are flared, such that the diameter of the end of the arms 30*a*, 30*b* is smaller than that of the end fixed to the spherical portion 26. Moreover, the arms have notches 31 that limit the translational movement of the pin 22 along the primary axis Y, through the housings 24*a*, 24*b*. The spherical portion 26 and the arms 30*a*, 30*b* are made as a single piece, or are formed in different molds and then secured together.

The writing roller 12 is mounted so as to be able to pivot on the spherical portion 26 around a secondary axis X perpendicular to the primary axis Y and to the longitudinal axis Z between the neutral position and a pivoting position. The writing roller 12 forms a ball joint with the spherical portion 26, this being made possible thanks to a recess 33 made in the internal part of the roller 12. This recess 33 complements the shape of the spherical portion 26, and allows the roller 12 to rotate more easily around the pin 22 along the secondary axis X and primary axis Y.

As shown, the axes intersect at point 32, which is the geometric center of the pin 22 and of the roller 12. This central arrangement of the axis X makes it possible to position the roller 12 parallel to the writing surface, once one end of the roller comes into contact therewith, and without the need for elastic return means.

Figure 2:
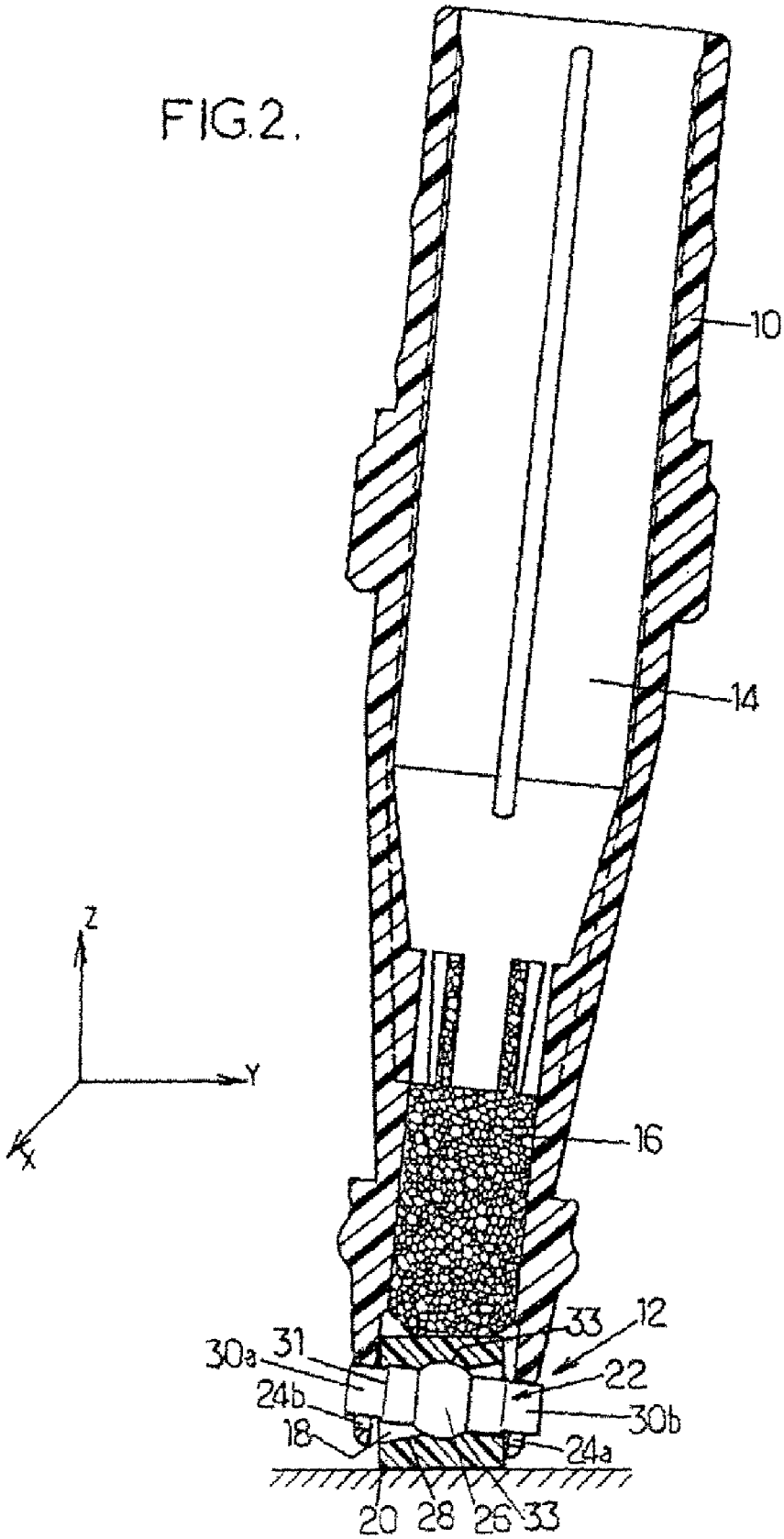
FIG. 2 is a view similar to FIG. 1, in which the writing implement has pivoted.

FIG. 2 shows the writing implement after the body has pivoted. The pivoting of the writing roller 12 around the secondary axis X is limited angularly by the arms 30*a*, 30*b* forming the pin 22 and the internal part of the writing roller. The more the arms 30*a*, 30*b* narrow toward their ends, the greater the angle of rotation of the writing roller 12 around the secondary axis X.

Likewise, the inside diameter of the hollow tube 18 increases toward each end of the roller 12 so as to allow a greater range of angular movement of the roller 22.

When the user takes the writing implement in his hand he can hold the body 10 in a direction that is tilted with respect to the writing plane. When the writing roller 12 comes into contact with the writing plane, it moves in translation along the longitudinal axis, toward the ink pad 16, owing to the user's bearing force. This movement is made possible thanks to the housings 24*a*, 24*b* of elongate shape provided in the body 10 of the writing implement, in which the arms 30*a*, 30*b* of the pin 22 slide. When the writing roller 12 is in contact with the ink pad 16, the ink then flows from the pad 16 toward the outer surface 12.

When the user moves the writing implement over the writing plane, the roller 12 turns on itself around the primary axis Y and the outer surface in contact with the ink pad 16 is reloaded with ink, which is then deposited on the writing plane.

Furthermore, depending on the angle at which the user holds the writing implement, the writing roller 12 pivots around the spherical portion 26 in such a way that the whole width of the roller 12 is in contact with the writing plane. This pivoting is limited angularly by the pin 22 and the internal part 28 of the wall of the roller which both come into contact at a point, thus preventing the roller 12 from pivoting further around the axis X.

The pin 22 and the roller 12 are connected by means of a simple ball joint, and can rotate or pivot independently of one another. In particular, in the writing position, i.e. when the body 10 is tilted, the roller 12 is parallel to the writing plane while the pin 22 is tilted at an angle substantially identical to the angle at which the body 10 is tilted.

The embodiment of the present invention described above is in no way limiting. In another embodiment of the present invention, the writing roller could pivot about the axis X by virtue of the interaction between an elastic connection that would return one end of the pin 22 to the center of an elongate opening and a ball joint or hinge at the other end of the pin.

The invention claimed is:

1. A writing implement comprising:

a body which extends longitudinally along a central axis Z and includes a first end and a second end;

an ink reservoir; and a roller having a radial outer writing surface, the roller being located at the first end, connected to the reservoir and being mounted so as to be able to rotate around a primary axis Y when displaced according to a direction of writing in which the writing implement is dragged over the surface to be marked;

a pin in contact with the roller;

wherein the roller is mounted so as to be able to pivot around a secondary axis X perpendicular to the primary axis Y, the secondary axis X intersecting the primary axis Y and being substantially parallel to the direction of writing, the secondary axis X intersecting the pin.

2. The writing implement according to claim 1, wherein the secondary axis X intersecting the central axis Z.

3. The writing implement according to claim 1, wherein the pin is positioned along the primary axis Y in a neutral position, the pin comprising, in a middle region, a spherical portion that forms a ball joint with the roller.

4. The writing implement according to claim 3, wherein the diameter of the spherical portion is substantially equal to the minimum diameter of a hollow tube of the writing roller.

5. The writing implement according to claim 3, wherein the body has at least two housings on either side of the pin, and the pin is mounted in the housings and is able to slide in the housings in a direction substantially parallel to the central axis Z.

6. The writing implement according to claim 3, wherein the diameter of the spherical portion is greater than the average diameter of the pin.

7. The writing implement according to claim 6, wherein the body has two housings on either side of the pin, and the pin is mounted in the housings and is able to slide in the housings in a direction substantially parallel to the central axis Z.

8. The writing implement according to claim 7, wherein the pin comprises two opposite arms extending through the housings from each side of the spherical portion.

9. The writing implement according to claim 1, wherein the roller is provided with a hollow tube, the hollow tube having an inside diameter that increases toward one of its ends.

10. The writing implement according to claim 1, wherein the roller is connected to the reservoir by means of an ink pad, and the ink pad is in communication at one of its ends with the reservoir and is in contact with the roller at its other end, to convey the ink from the reservoir to the roller.

11. The writing implement according to claim 1, wherein the outer surface of the roller is cylindrical.

12. A writing implement comprising:

a body which extends longitudinally along a central axis Z and includes a first end and a second end;

an ink reservoir; and a roller having a radial outer writing surface, the roller being located at the first end, connected to the reservoir and mounted so as to be able to rotate around a primary axis Y when displaced according to a direction of writing in which the writing implement is dragged over the surface to be marked, a pin positioned along the primary axis Y in a neutral position, wherein the roller is mounted so as to be able to pivot around a secondary axis X perpendicular to the primary axis Y, the secondary axis X intersecting the primary axis Y, and being substantially parallel to the direction of writing and, wherein the pin comprises, in a middle region, a spherical portion that forms a ball joint with a roller.

13. A writing implement comprising:

a body which extends longitudinally along a central axis Z and includes a first end and a second end;

an ink reservoir; and a roller having a radial outer writing surface, said roller being located at the first end, connected to the reservoir and mounted so as to be able to rotate around a primary axis Y when displaced according to a direction of writing in which the writing implement is dragged over the surface to be marked, wherein the roller is mounted so as to be able to pivot around a secondary axis X perpendicular to the primary axis Y, the secondary axis X intersecting the primary axis Y, and being substantially parallel to the direction of writing; and wherein the roller is provided with a hollow tube, the hollow tube having an inside diameter that increases toward one of its ends.

* * * * *